United States Patent [19]

Butler

[11] Patent Number: 4,865,198

[45] Date of Patent: Sep. 12, 1989

[54] OVERWRAPPED PACKAGE WITH TAMPER INDICATING MEANS

[75] Inventor: John P. Butler, Winston-Salem, N.C.

[73] Assignee: R. J. Reynolds Tobacco Company, Winston-Salem, N.C.

[21] Appl. No.: 150,944

[22] Filed: Feb. 1, 1988

[51] Int. Cl.[4] ..... B65D 27/18; B65D 33/34

[52] U.S. Cl. ..... 206/459; 206/807

[58] Field of Search ..... 206/807, 459

[56] References Cited

U.S. PATENT DOCUMENTS

| | | | |
|---|---|---|---|
| 3,623,944 | 11/1971 | Davis . | |
| 3,631,617 | 1/1972 | Pekko . | |
| 3,854,581 | 12/1974 | Jones, Jr. . | |
| 3,864,855 | 2/1975 | Pekko et al. . | |
| 3,896,965 | 7/1975 | Cornell . | |
| 3,923,198 | 12/1975 | Brochman . | |
| 3,933,304 | 1/1976 | Judd | 206/807 X |
| 3,935,960 | 2/1976 | Cornell . | |
| 4,082,873 | 4/1978 | Williams . | |
| 4,121,003 | 10/1978 | Williams . | |
| 4,180,929 | 1/1980 | Schultz, Jr. . | |
| 4,184,701 | 1/1980 | Franklin et al. . | |
| 4,197,947 | 4/1980 | Zaidi | 206/807 X |
| 4,436,213 | 3/1984 | Paul, Jr. et al. . | |
| 4,475,661 | 10/1984 | Griffin . | |
| 4,488,646 | 12/1984 | McCorkle . | |
| 4,597,593 | 7/1986 | Maurer . | |
| 4,608,288 | 8/1986 | Spindler . | |
| 4,653,113 | 3/1987 | Taylor | 206/807 X |
| 4,709,396 | 11/1987 | Voshall et al. | 206/807 X |
| 4,718,553 | 1/1988 | Adamdi et al. | 206/459 |
| 4,749,084 | 6/1988 | Pereyra | 206/459 |
| 4,760,919 | 8/1988 | Pereyra | 206/807 |

*Primary Examiner*—William Price

*Attorney, Agent, or Firm*—Stephen M. Bodenheimer, Jr.

[57] ABSTRACT

The instant invention relates to processes for producing tamper-evident overwrapped packages as well as the products which are produced. These processes utilize various energizing sources to create tamper-evident patterns between the package surface and the underside of the clear overwrap film closure. Tamper-evident patterns can also be created between heat-sealed overlapping sections of the overwrap film.

5 Claims, 1 Drawing Sheet

FIG. 1
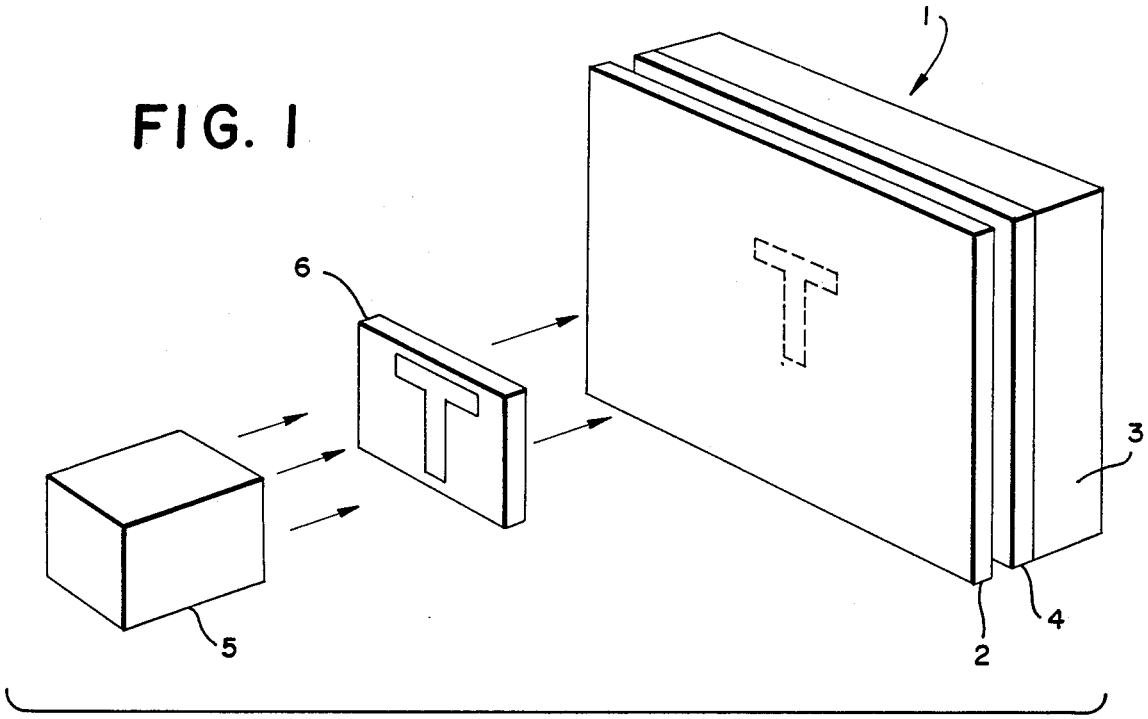
FIG. 2
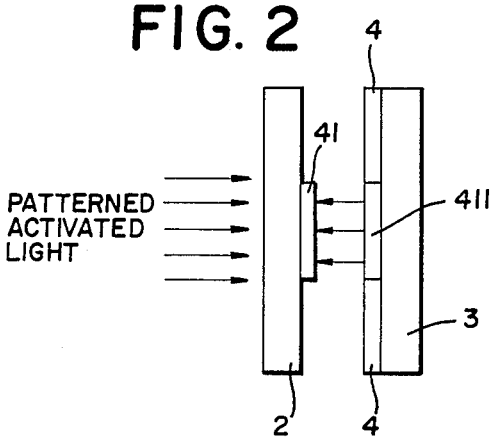
FIG. 3
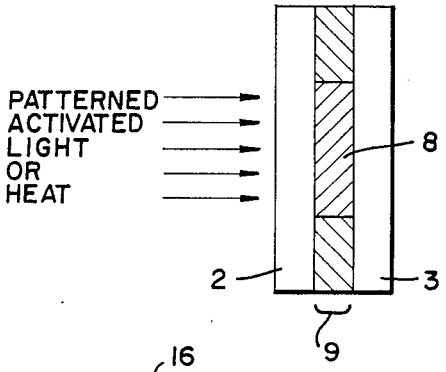
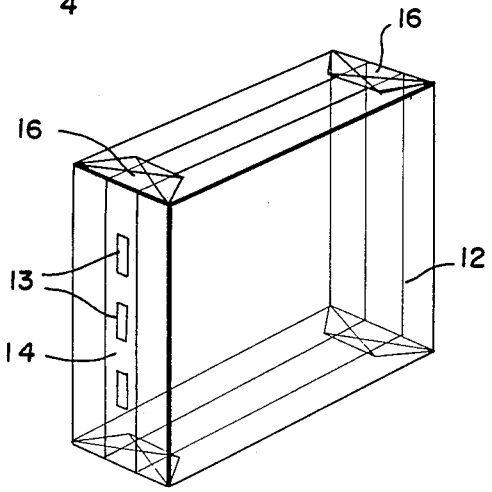
FIG. 4

OVERWRAPPED PACKAGE WITH TAMPER INDICATING MEANS

BACKGROUND OF THE INVENTION

Many consumer products now provide indicia to display the effects of unauthorized tampering with the products. Some consumer products, such as for example, medicines, food products and cigarettes, are marketed in packages wrapped with a clear overwrap film closure. This overwrap film closure is generally removed by means of a tear strip to gain access to the interior package. There has been to this point no means for providing for a coordinated tamper-evident display between the overwrap film closure and the interior packaging substrate.

The instant invention relates to tamper-evident overwrapped products and processes for the production thereof which clearly provide the consumer with evidence of any attempt at prior entry through the overwrap film closure.

SUMMARY OF THE INVENTION

The present invention relates to a method for imprinting overwrapped packages and to the products produced thereby. This method produces an imprinted image on the interior surface of an overwrap film by vaporizing ink from an underlying substrate. To this end, an overwrap such as clear polypropylene is placed over a printed or pigmented package or substrate. An activating energy source such as a pulsed laser beam is used to imprint words or symbols on the overlying film by vaporizing ink or pigment from the underlying substrate. The vaporized ink transfers in register to the inside surface of the overwrap and unless one of the surfaces is moved with respect to the other, no tamper-evident indicium appears to be present in the overwrapped package structure.

In an alternative embodiment of the instant invention, a thermotropic ink is provided on the package or substrate. Vaporization of the thermotropic ink by an activating energy source produces a simultaneous change of color. Thus, the ink transferred to the inside surfaces of the overwrap is contrasting in color and easily visible but remains in register with the vaporized pattern which has been produced on the package or substrate to provide a tamper-evident feature.

In another embodiment of the instant invention, adhesives or polymer coatings are utilized on the substrate and are activated by laser energy in a controlled manner or by a heat source so as to bond certain areas of the overwrap film closure to the underlying substrate, thus producing a visibly disrupted contact pattern when the overwrap film closure is opened. The resultant bonded pattern makes the packaged product tamper-evident as any disruption of the bonded pattern is clearly apparent.

In another embodiment of the instant invention indicia in the form of an adhesive ink are heat-sealed between the overlapping areas of the overwrap film during heat-sealing operations to provide a tamper-evident seal.

BRIEF DESCRIPTION OF THE DRAWINGS

FIG. 1 is a representation of an overwrap on an ink-coated substrate which is being activated through a mask.

FIG. 2 is a schematic representation of ink transferring from the substrate to the overwrap during laser treatment.

FIG. 3 is a schematic representation of an adhesive layer between an overwrap and a substrate which is activated only in certain areas.

FIG. 4 is a front elevational perspective view of a heat-sealed overwrap closure.

DETAILED DESCRIPTION OF THE INVENTION

In the illustration given and with reference first to FIG. 1, the overwrapped package assembly 1 comprises an external layer of flexible transparent or translucent overwrap plastic film 2. In all embodiments of the instant invention the overwrap film must have sufficient transparency or translucency so that a pattern disposed on its inner surface is visible through the film. The chemical nature of the film is not critical so long as it (1) has sufficient film integrity for its intended protective use, (2) provides a surface having appropriate ink affinity characteristics, and (3) is essentially transparent, or sufficiently conductive with respect to the energy source used to vaporize or activate the underlying coatings or pigments. Preferred films include single or multiple layer films comprising polyolefins such as homopolymers and copolymers or ethylene or polypropylene, most preferably oriented polypropylene. Other useful polymers for film layers include polyester films such as Mylar; acrylic polymers and interpolymers, cellulosic polymers including cellulose acetate, cellulose acetate butyrate, cellulose acetate proprionate and mixture thereof; polystyrene, polycarbonates, vinyl chloride polymers and interpolymers including such polymers compounded with property modifying adjuvants such as those known in the art. With appropriate selection of energy type and level, wavelength and the link, the process is amenable to any of the optically transparent overwrap films used commercially.

The overwrapped package further includes a package of substrate 3 which can be constructed from any suitable packaging material such as paper, metal, glass, plastic or the like with a heat-labile ink, pigment, or adhesive coating 4 disposed on the surface of the substrate 3 in non-bonded contact with the overwrap plastic film 2. The heat-labile ink which is employed in the instant invention can be any ink which can be vaporized by an energy source such as light provided from a pulsed laser. Furthermore, the ink can be thermotropic in nature so that direct heat application causes a change in color. Suitable ink compounds for use in the instant invention include but are not limited to pigmented inks. For example, a transparent ink that becomes opaque under the influence of heat would be well suited to the present purpose.

In addition to an ink coating, the coating 4 can be an adhesive which is activated or cured by energy supplied from an activated light source 5, typically a pulsed laser beam of light or UV light source.

As displayed in FIG. 1, a high energy light source 5 projects an activating light beam through a stencil mask 6 and then the beam is focused through the overwrap 2 onto the printed or coated package surface 4. As defined herein wave energy supplied from an activating light source is the wave energy supplied by any coherent light source such as a pulsed laser, UV light source, etc. A $CO_2$ laser with an output energy level of five Joules at a wave length of 10.6 $\mu$m. has been found to be effective for marking overwrapped packages in the manner described herein.

FIG. 2 displays a patterned laser beam passing through an overwrap layer 2 and striking an ink coating 4 on a substrate 3, thereby evaporating ink from the substrate 3 and depositing the evaporated ink in a registered ink pattern 41 on the ink facing side of the overwrap layer 2. While a space is displayed between the overwrap 2 and the ink layer 3 in FIG. 2 for purposes of illustration, however, the overwrap is generally in direct but non-bonded contact with the ink coating in the instant embodiment.

As displayed in FIG. 2, ink which is evaporated from the package substrate surface is deposited on the inner face of the overwrap. While no bonding occurs between the substrate 3 and the overwrap 2 when non-adhesive ink 4 is utilized, the ink 41 which is deposited upon the interior surface of the overwrap layer is in register with a corresponding inverse pattern coating of the de-inked surface 411 of the package substrate 3. Thus, any unauthorized movement of the overwrapped layer is clearly visible as ink pattern which is deposited on the overwrap layer will no longer be in register with the de-inked surface of the package substrate.

FIG. 3 displays an alternative embodiment of the instant invention in which a patterned laser beam passing through an overwrap layer 2 cures or activates an adhesive section 8 of an adhesive layer 9 which was previously coated on a substrate 3.

Hardening of the adhesive layer 9 of the laminate can be effected by means of high energy radiation such as UV light. The adhesive layer used according to the invention contains, as substances which can be hardened by radical cross-linking, ethylenically unsaturated, monomeric oligomeric or polymeric compounds, mainly $\alpha,\beta$-unsaturated compounds or compounds containing vinyl groups, and in particular compounds containing acrylate and/or methacrylate groups.

According to a preferred embodiment, ethylenically unsaturated oligomeric or polymeric compounds capable of being hardened by radical cross-linking are used, in particular those based on polyesters, $\alpha,\beta$-unsaturated polyesters, polyethers, polyepoxides, polyurethanes, urethane modified polyepoxides, urethane modified polyester, urethane modified polyethers and unsaturated polymers.

The adhesive layer according to the invention may be cross-linked by means of high energy radiation such as UV light, electron rays or gamma rays. When UV-light is used, the layer is exposed to this light in the presence of photoinitiators. The photoinitiators may be the usual compounds used for this purpose such as, for example, benzophenone and aromatic ketone compounds derived from benzophenone in general, such as alkylbenzophenones, halogen methylated benzophenones, Michlers ketone, and halogenated benzophenones. Benzoin and anthraquinone and numerous of its derivatives are also effective photoinitiators; for example, $\beta$-methylanthraquinone, tert.-butyl anthraquinone and anthraquinone carboxylic acid esters; oxime esters, phenyl glyoxylic acid esters, benzyl dimethylketal, benzoin isopropylether and the benzophenone/amine systems are particularly suitable photoinitiators.

The adhesive layer according to the invention may also be cross-linked by the addition of polymerization initiators which when activated by heat release a radical polymerization, i.e. polymerization effected by so-called external radical formers. The heat may be supplied by a pulsed laser.

The following are examples of conventional polymerization initiators: acyl peroxides such as diacetyl peroxide, dibenzoyl perozide, di-p-dichlorobenzoyl peroxide and benzoylperoxide; peroxidic esters such as tert.-butyl peroxyacetate, tert.-butyl peroxybenzoate, tert.-butyl peroctoate, dicyclohexyl peroxycarbonate and 2,5-dimethylhexane-2,5-diperoctoate; alkyl peroxides such as bis-(ter.-butyl peroxybutane), dicumyl peroxide, tert.-butyl cumyl peroxide, tert.-butyl peroxide, and lauroyl peroxide; hydroperoxides such as cumene hydroperoxide, tert.butyl hydroperoxide, cyclohexanone hydroperoxide, methyl ethyl ketone hydroperoxide and methyl isobutylketone hydroperoxide, perketals such as 1,1-ditert.-butyl peroxy-3,3,5-trimethylcyclohexane, ketone peroxides such as azo compounds such as azoisobutyrodinitrile, and acetylacetone peroxide.

It may be advantageous to add certain accelerators to increase the reactivity, such as, for example, cobalt or vanadium naphthenate or octoates, tertiary amines, amides, amidlines, sulphinic acid, mercaptans or arylphosphinic acid esters. It may be further advantageous, in order to prevent premature activity of the polymerization initiators, possibly in conjunction with accelerators, to add the polymerization initiator and/or the accelerator to the adhesive compounds according to the invention in a microcapsular form.

The polymerizable compounds according to the invention which are to be hardened by radical cross-linking may be protected against premature polymerization by adding to them, at the stage of their preparation, from 0.001 to 0.1% by weight, based on the whole mixture of polymerization inhibitors or antioxidants.

The thickness of the adhesive layer 9, when dry, depends on the particular requirements and the adhesive power of the compound which is to be hardened. Thicknesses of from 2 to 50$\mu$ would be generally sufficient. The curing of the adhesive section 8 creates a bond between the package substrate 3 and the overwrap layer 2 which if disturbed is plainly visible.

Bonding of two surfaces, one transparent and the other opaque to high intensity light sources, is not restricted to chemical activation or curing as described above. A focused laser beam could be used to heat activate a hot melt or other heat sensitive adhesive coated onto the receptor substrate. The two surfaces in contact would form a patterned bond as the adhesive cooled to ambient temperature.

In any of the foregoing embodiments, the coating 4 which is present on the substrate 3 prior to treatment with wave energy supplied from an activated light source can be a full or a partial coating of the substrate. Thus, only a coated substrate area can be activated by the predetermined pattern of wave energy as the uncoated substrates are not affected by the wave energy.

In the foregoing embodiments discussed heretofore, the predetermined pattern of wave energy which is supplied from an activating light source is projected through the overwrap to strike the ink or uncured adhesive coating on the substrate. The ink coating is activated by vaporizing from the substrate and depositing on the inner surface of the overwrap layer in register with the corresponding inverse pattern retained on the non-evaporated ink coating on the substrate. A tamper-evident pattern is thus established between the overwrap which is now printed on its underside and the corresponding vaporized pattern on the coated substrate. Any attempt to remove the overwrap will cause a misalignment of the printing of the underwrap with the vaporized pattern on the coated substrate.

When an uncured adhesive coating is utilized as in FIG. 3, the predetermined pattern of wave such as UV light energy activates by curing a section of adhesive coating 8, thus bonding the substrate 3 and the overwrap layer 2 in a tamper-evident pattern. Any attempt to remove the overwrap 2 breaks the adhesive bonding between the overwrap and the substrate which will provide evidence of tampering by the clearly visible broken adhesive bonds. The remaining portion of adhesive layer 9 which is not activated does not bond to the overwrap layer but remains coated on the substrate.

In another embodiment of the instant invention as displayed in FIG. 3, heat-activatable adhesive ink coating 9 is employed on the packaging substrate 3. A portion 8 of the adhesive layer is activated by a heat source such as a heated platen. Patterned heating of the adhesive ink coating cures the adhesive which bonds the packaging substrate 3 to the overwrap film 2. This method is useful during standard packaging overwrapping procedures. Normally overwrapped packages such as medicines, food products or cigarettes are held in a slot on a radial wheel and the sideseam of the overwrap is twice heated so that it will seal to itself. Next, the top and bottom end flaps are folded and then twice heated by heated platens so that the end flaps seal to themselves. A tamper-evident pattern is created in accordance with the instant invention by utilizing a patterned heat-activatable adhesive ink coating at preselected locations on the substrate either under the sideseam or below the end flaps. Thus the heat-activatable adhesive ink coating bonds the substrate to the overwrap film during normal overwrapping procedures. Any attempt to remove the overwrap film at the heat sealed closures will ~~result in~~ broken adhesive bonds between the overwrap film and the substrate which will provide evidence of tampering.

In another embodiment of the instant invention as displayed in FIG. 4, a patterned heat-activatable adhesive ink is utilized between overlapping areas of the heat-sealable overwrap film. As previously discussed the overwrap film is heated by heated platens to effect a continuous overwrap film closure 12. In the instant embodiment, indicia means such as a heat-activated adhesive ink 13 is deposited on a surface of the overwrap film at preselected locations. These adhesive ink coated locations are selected such that they come in bonding contact with other portions of the overwrap film during heat-sealing to form a heat-sealed joint 14 containing adhesive ink indicia 13. Thus the adhesive ink indicia may be present between any overlapped heat-sealed areas of the overwrap film layer such as the sideseam 14 or the folded end flaps 16 of the final closure structure 12. Any attempt to disrupt the integrity of overwrap closure structure by disassembling at the heat-sealed joints would result in an immediate display of a disrupted adhesive ink pattern which would clearly indicate a tampering of the overwrap closure structure.

While the embodiments of the instant invention have been discussed in the context of tamper-evident patterns it is obvious that the process and products of the instant invention can be utilized for alternative functions. Such alternative functions ar considered to be part of the instant invention and fall within the claims as presented. For instance, the use of laser imprinting on a thermotropic ink on the packaging substrate provides a method of imprinting information inside the overwrap film closure such as an expiration date. While the alignment of characters provide for tamper-evidence as previously discussed, it serves the dual function of providing information to the consumer. As such imprinting of information from the surface of the substrate to the underside of overwrap film closures falls within the scope of the instant invention as it is discussed and claimed as a tamper-evident pattern.

While in the foregoing specification a detailed description of embodiments of the invention has been made for the purpose of illustration, many variations in the details given herein may be made by those skilled in the art without departing from the spirit and scope of the instant invention.

What is claimed is:

1. A tamper-evident overwrapped package comprising:

(a) a package, (b) a transparent film closure overwrapping the package and having at least one heat-sealed overlapped joint, and (c) disruptible indicia means between the overlapped layers of the joint for indication of tampering with the heatsealed joint.

2. The package as defined in claim 1 wherein the indicia means is an ink imbedded in the joint to provide tamper-evidence.

3. The package as defined in claim 2 wherein the ink is a heat-activated adhesive ink.

4. The package defined in claim 1, 2 or 3 wherein the transparent film closure comprises a tear strip for gaining access to the interior of the overwrap.

5. The package defined in claims 1, 2, or 3 wherein the overwrapped package is an overwrapped package of cigarettes.

* * * * *